US006387183B1

(12) United States Patent
Inaba et al.

(10) Patent No.: US 6,387,183 B1
(45) Date of Patent: May 14, 2002

(54) PAINT MASK APPARATUS

(75) Inventors: Keiichi Inaba; Kiyoshi Yazaki, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 90 days.

(21) Appl. No.: 09/633,339

(22) Filed: Aug. 4, 2000

(30) Foreign Application Priority Data

Aug. 4, 1999 (JP) ..... 11-220844

(51) Int. Cl.[7] ..... B05C 15/04

(52) U.S. Cl. ..... 118/301; 118/500; 118/504; 118/505

(58) Field of Search ..... 118/500, 504, 118/505, 301, 406; 427/282; 269/55

(56) References Cited

U.S. PATENT DOCUMENTS 4,813,843 A * 3/1989 Gilmour et al. ..... 264/55
5,985,465 A 11/1999 Daichou et al. ..... 428/458
6,135,050 A 10/2000 Inaba et al. ..... 118/301

FOREIGN PATENT DOCUMENTS

JP 4-322760 11/1992
JP 4-338252 11/1992

* cited by examiner

*Primary Examiner*—Laura Edwards
(74) *Attorney, Agent, or Firm*—Sughrue Mion, PLLC

(57) ABSTRACT

A paint mask apparatus in which portions that were difficult to paint conventionally can easily be painted by constructing the apparatus main body so as to be tiltable. A paint mask apparatus main body having a receiving jig for mounting a work on a base and a mask main body which covers the work mounted on the receiving jig is constructed so as to be tiltable around a horizontal axis. Spray painting is then carried out with the paint mask apparatus main body into which the work has been set tilted around the horizontal axis such that the areas to be painted of the work are pointed in a predetermined direction that makes it easy to apply paint. The paint mask apparatus enables paint to easily be applied to portions that were difficult to paint in the past, as well as a plurality of different places.

11 Claims, 8 Drawing Sheets

PAINT MASK APPARATUS

BACKGROUND OF THE INVENTION

The present invention relates to a paint mask apparatus used in a painting process to restrict application of paint to only a preferred area of a molded part such as a lens or a lamp body, which are component parts of a vehicular lamp, for example.

A conventional paint mask apparatus of the same general type as that to which the invention pertains, as shown in FIG. 8, is constructed with a receiving jig 3 for mounting a part 7 to be painted, which in turn is supported by a jig base 2 provided in an outer base 1. A mask supporting frame 5 with an integrated mask main body 6 shaped to correspond to the part 7 to be painted is attached to the outer base 1 in such a manner as to be able to swing up and down so that the mask main body 6 can selectively cover (broken line in FIG. 8) and uncover (solid line in FIG. 8) the receiving jig 3 and the part to be painted 7 from above.

Reference numeral 4 denotes a link mechanism that raises and lowers the jig base 2. Reference numeral 4*a* indicates a lever for raising and lowering the link mechanism 4 such that by raising the receiving jig 3 with respect to the mask main body 6, the part 7 to be painted is covered in the correct position by the mask main body 6.

An opening (not shown) corresponding to the area to be painted of the part 7 is formed in the mask main body 6. Spray paint is applied from above the mask main body 6 with the mask main body 6 covering the part 7 so as to paint only the desired area to be painted.

However, when the area P to be painted of the part 7 to be painted is on the rear side of an overhanging portion 7*a*, painting becomes more difficult because it is necessary to spray at an upward angle from below, as indicated by the arrow A. It is also difficult to install the spray gun for use in such a case. Moreover, the paint mist tends to be dispersed, thus deteriorating the painting quality.

Also, when there are several areas that require painting on the same part to be painted, several different types of mask main bodies having an opening which corresponds to each area to be painted must be prepared beforehand. The mask main bodies must also be changed with each painting operation, and the alignment of the spray gun must be adjusted so that it points in the direction of the area to be painted. These and other operations in the painting process are troublesome.

SUMMARY OF THE INVENTION

An object of the present invention is to overcome the problems noted above by providing a paint mask apparatus wherein the paint mask apparatus main body is made tiltable so that paint can be applied to a predetermined portion considered difficult to paint conventionally, and which enables paint to be applied to a plurality of areas to be painted in a single painting process.

In order to achieve the foregoing and other objects of the invention, a paint mask apparatus according to the invention is constructed so as to have a paint mask apparatus main body having a receiving jig for mounting a work, namely, a part to be painted, to a movable base, and a mask main body which covers this work mounted to the receiving jig, wherein the apparatus main body is mounted so as to be tiltable around a horizontal axis.

That is, the entire paint mask apparatus main body into which the work to be painted is made to be tiltable around a horizontal axis. The area or areas to be painted of the work supported by the paint mask apparatus main body is then pointed in a predetermined direction to facilitate the painting process.

The paint mask apparatus may be formed such that means for fixing and maintaining the paint mask apparatus main body in a predetermined position around the horizontal axis is provided on the paint mask apparatus.

The fixing and maintaining means fixes and maintains the paint mask apparatus main body in a predetermined tilted position around the horizontal axis. As a result, the work is held pointed in a predetermined direction, which facilitates the painting of a predetermined area to be painted.

The paint mask apparatus may be constructed such that the paint mask apparatus main body is supported from below by a fixed base. The paint mask apparatus main body is suspended by a pair of supports provided on both the left and right sides of the paint mask apparatus on the side of the fixed base which forms the horizontal axis.

Extending and retracting the paint mask apparatus main body enables the paint mask apparatus main body to swing (tilt) in a pendulum-like manner around the horizontal axis (pair of supports) on the fixed base side. Also, the paint mask apparatus can be moved by changing the position of the fixed base.

Further, the paint mask apparatus may be formed with the horizontal axis provided above the center of gravity of the paint mask apparatus main body.

The paint mask apparatus main body of the invention has good stability because the center of gravity of the paint mask apparatus main body, i.e., the pendulum, is below the center (horizontal axis) of the pendulum.

Still further, the paint mask apparatus may be formed with opposing vertical walls to which the horizontal axis provided on the fixed base is attached, and the fixing and maintaining means is disposed between the vertical walls and the movable base. The fixing and maintaining means may be implemented with a stopper pin provided on the moveable base side and which is spring-loaded in the direction in which the tip portion thereof projects to the vertical wall side, a plurality of pin engaging holes are provided along the path of travel of the stopper pin in the vertical wall and with which the stopper pin is able to engage, and a release lever that moves in the direction against the force of the spring is provided so as to disengage the stopper pin from the pin engaging hole.

When the stopper pin is disengaged from the pin engaging hole, the paint mask apparatus main body can be tilted around the horizontal axis. However, when the stopper pin is in a state in which it is engaged with the pin-engaging hole in the vertical wall, the paint mask apparatus main body is maintained fixed to the vertical wall.

By operating the release lever, the stopper pin can be engaged with and disengaged from the pin engaging hole.

In particular, when the paint mask apparatus main body is tilted and the stopper pin arrives at a position corresponding to a predetermined pin engaging hole, the stopper pin automatically engages the pin engaging hole by the force of the spring without the release lever having to be operated so as to fix and maintain the paint mask apparatus main body in a predetermined position around the horizontal axis.

The work may be a lens for a vehicular lamp having a surface design portion and a leg portion and in which an overhanging portion that protrudes to the outside beyond the leg portion is formed on the side edge of the surface design portion so that the area from the rear side of the overhanging portion to the outside of the leg is the area to be painted.

Tilting the pain mask apparatus main body and opening the area from the rear side of the overhanging portion of the lens to the outside of the leg portion (the area to be painted) in the direction of painting enables the area to be painted to be readily and reliably painted.

DESCRIPTION OF THE PREFERRED EMBODIMENTS

Figure 1:
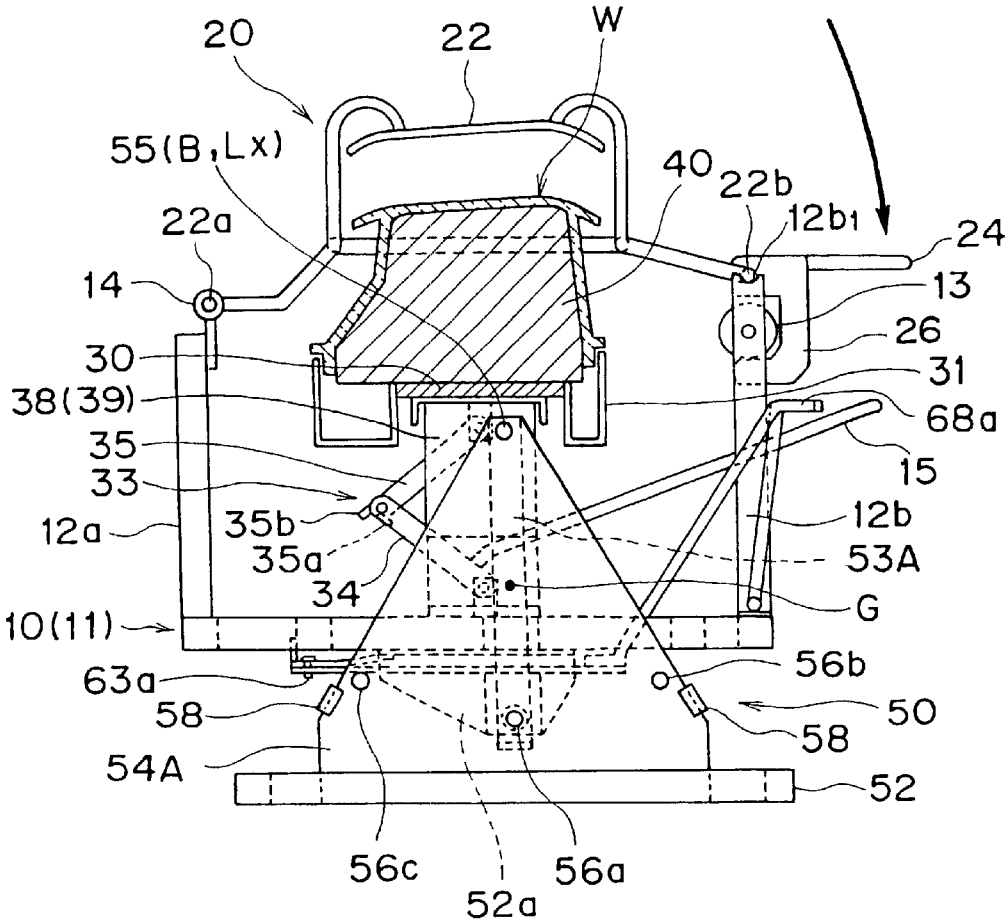
FIG. 1 is a side view of a paint mask apparatus constructed in accordance with a first embodiment of the present invention.

The present invention will now be further described with reference to preferred embodiments thereof.

Referring to FIGS. 1 to 7 of the drawings, reference numeral 100 denotes a composite resin lens for a vehicular lamp (hereinafter referred to as the work W), which is a part to be painted, in which a leg portion 104 is formed around a substantially flat surface design portion 102. An overhanging portion 103 which protrudes to the outside beyond the leg portion 104 is formed on opposing side edges (the opposing side edges to the left and right in FIG. 2) of the surface design portion 102 so as to extend slanting downward. The area indicated by reference numerals $A_1$, $A_2$ from the rear of the overhanging portion to the outside of the leg portion 104 is the area to be painted.

Reference numeral U (FIG. 4) denotes a paint mask apparatus main body in which a receiving jig 40 for mounting the work W and a mask main body 22 that covers the, work W mounted on the receiving jig are provided on a moveable base 10. The paint mask apparatus main body U is tiltable around a horizontal axis Lx.

On the moveable base 10, the receiving jig 40 is integrally fixed to the receiving jig 30, which can be raised and lowered by a link mechanism 33. The mask supporting frame 20 with an integrated mask main body 22 shaped so as to correspond to the work W is attached to the moveable base 10 so as to be able to swing up and down, as shown in FIGS. 1 and 2.

Figure 2:
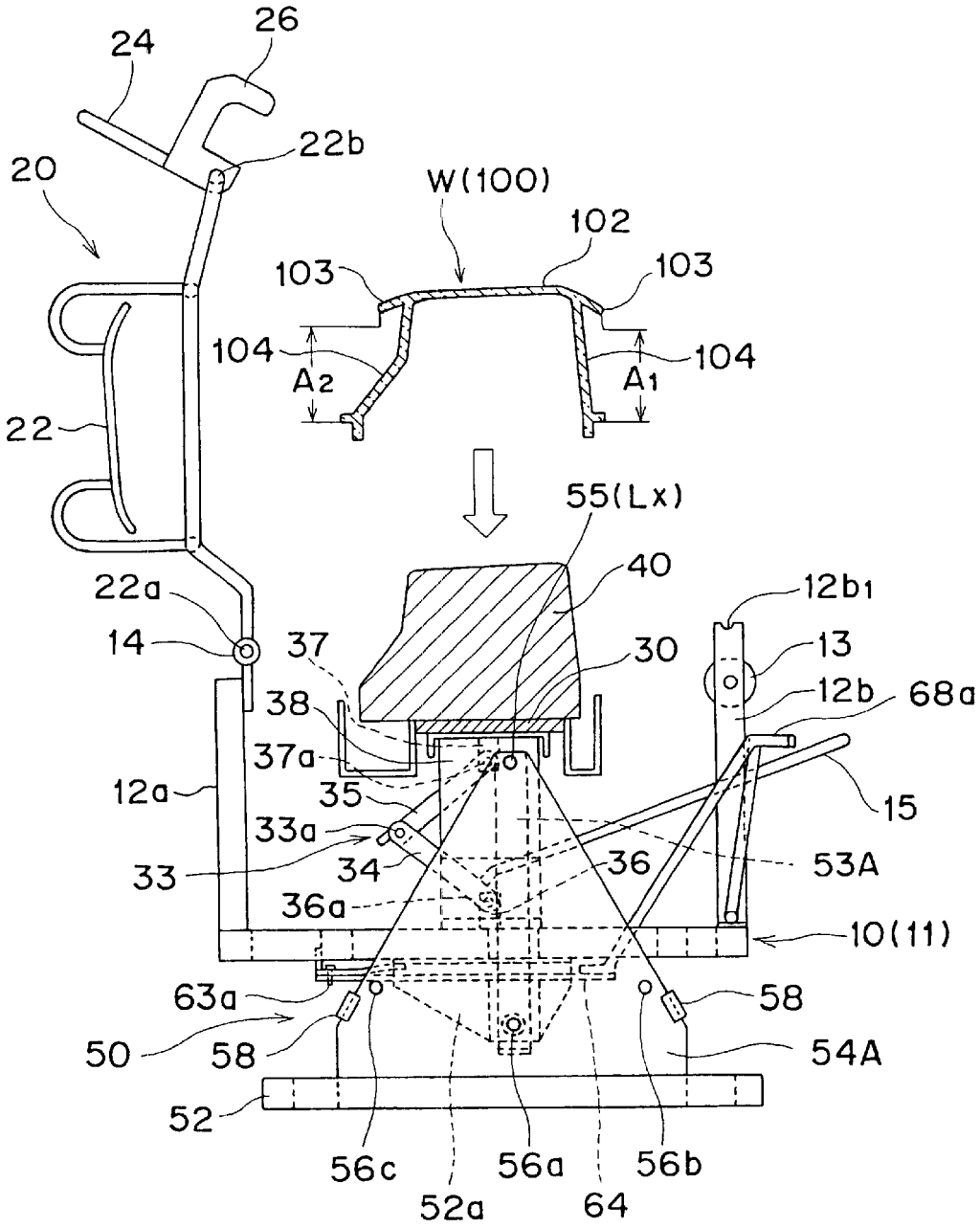
FIG. 2 is a side view of the same apparatus in which the area above the receiving jig is in an open state.
Figure 7A:
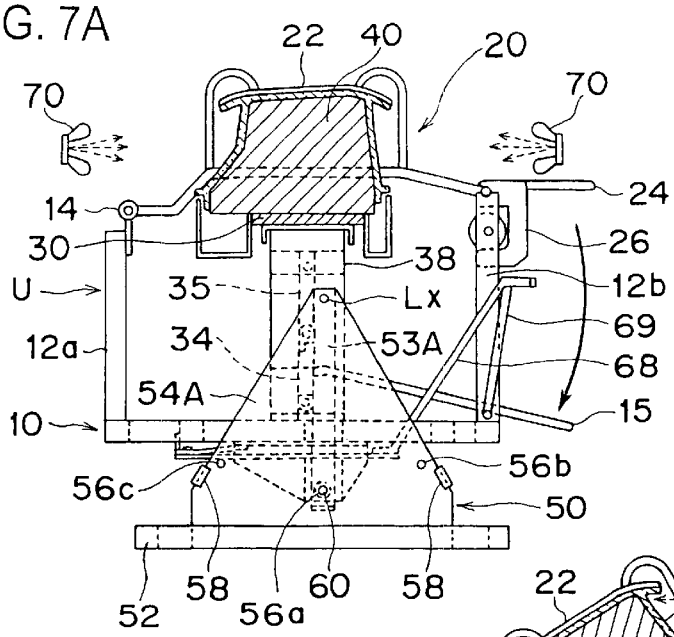
FIG. 7A is a side view of the same apparatus in which the mask main body in a covered state showing the same apparatus while it is being used in a painting process.

As shown in FIG. 1, the mask supporting frame 20 (the mask main body 22) is closed so as to be positioned directly over the receiving jig 40 (the work W). The jig base 30 is then raised by the link mechanism 33 such that, except for the area to be painted, the work W is maintained covered by the mask main body 22, as shown in FIG. 7A. Using a spray gun 70 to spray paint the work W from the side (the left/right direction in FIG. 7A), paint can be applied to only a predetermined area of the work W.

The moveable base 10 is constructed with braces 12*a*, 12*b* standing upright at the four corners of the front and rear ends of the frame body 11, which is rectangular when viewed from above. A bearing 14 that supports the mask supporting frame 20 with an integrated mask main body 22 so that it can swing up and down is provided on the upper end portions of the pair of left and right braces 12*a*, 12*b* on the front end side. A horizontal rod 22*a* on the front end side of the mask main body 22 is supported by the bearing 14 so that the mask supporting frame 20 can swing up and down therearound, such that the mask supporting frame 20 (mask main body 22) can close with the mask main body 22 in a position directly above the receiving jig 40 (the work W) (see FIG. 1), and spring up, opening above the receiving jig 40 (molded part W) (see FIG. 2).

A pair of left and right hooks 26 integrated with a handle 24 are rotatably provided on the horizontal rod 22*b* on the rear side of the mask supporting frame 20. U-shaped grooves $12b_1$ with which the horizontal rod 22*b* on the mask supporting frame 20 side are engageable are provided on the upper end portions of the pair of left and right braces 12*b* on the rear side, and latches 13 for securing the hooks 26 are provided on the left and right braces 12*b*. The hook 26 is retained by a hook retaining portion 13 provided on the brace 12*b* so as to maintain the mask supporting frame 20 (the mask main body 22) in a closed state.

The link mechanism 33, which is used for raising and lowering the jig base 30 that supports the receiving jig 40, is composed of a first link 34 with one end pin-connected to the frame body 11 of the base 10 and a second link 35 with one end pin-connected to the jig base 30 and the other end pin-connected to the other end of the first link 34. An operating lever 15 extending so as to slant upward is attached to the first link 34.

Raising and lowering the operating lever 15 raises and lowers the first link 34, activating the link mechanism 33 so that the jig base 30 is raised and lowered.

Reference numeral 36 denotes a bracket on the base 10 side to which the first link 34 is pin-connected, and reference numeral 37 denotes a bracket on the jig base 30 side to which the second link 35 is pin-connected. Reference numerals 33*a*, 36*a* and 37*a* indicate pin-connecting portions. Reference numeral 35*a* denotes a stopper provided on the inside of the first link 34 which prevents the second link 35 from rotating more than is desired by a lower end step portion 35*b* of the second link 35 abutting with the stopper 35*a* when the link mechanism 33 is raised. Reference numerals 38 and 39 respectively denote a cylinder and a guide rail provided between the frame body 11 of the base 10 and the jig base 30 on both the left and right sides (both sides in a direction perpendicular to the paper in FIG. 1) of the link mechanism 33 which serve as a guide mechanism for raising and lowering the jig base 30 directly up and down. Reference numeral 31 denotes a cover fixed to the jig base 30 so as to surround the jig base 30.

Reference numeral 50 denotes a fixed base which supports the apparatus main body U from below, in which a pair of left and right flat vertical walls 54A, 54B are provided opposing one another on a base portion 52 of a frame body, which is rectangular when viewed from above, set on a floor. Bolt holes $H_1$ (see FIG. 4) are provided in the upper end portions of both vertical walls 54A, 54B and a connecting bolt B is inserted into these holes $H_1$. A pair of supports 55 which support the apparatus main body U are provided which form a horizontal axis Lx.

Three pin-engaging holes 56*a*, 56*b*, 56*c* with which a stopper pin 60 provided on the moveable base 10 is engageable are provided in one of the vertical walls 54A. The pin engaging holes 56*a*, 56*b*, 56*c* are formed along the path of travel 60*a* of a stopper pin 60, with the hole 56*a* being positioned directly below the bolt hole $H_1$ (the support 55) and the holes 56*b*, 56*c* each being positioned at angles θ of about 30 degrees in front and to the rear with respect to a perpendicular line $L_1$ which intersects with the hole 56*a*. Reference numeral 58 denotes a stopper provided on the vertical walls 54A, 54B which limits the tilt angle of the apparatus main body U. Vertical plates 53A, 53B on the apparatus main body U side, to be described in more detail later, abut the stopper 58 such that the apparatus main body U is prevented from tilting past the abutment point.

Figure 4:
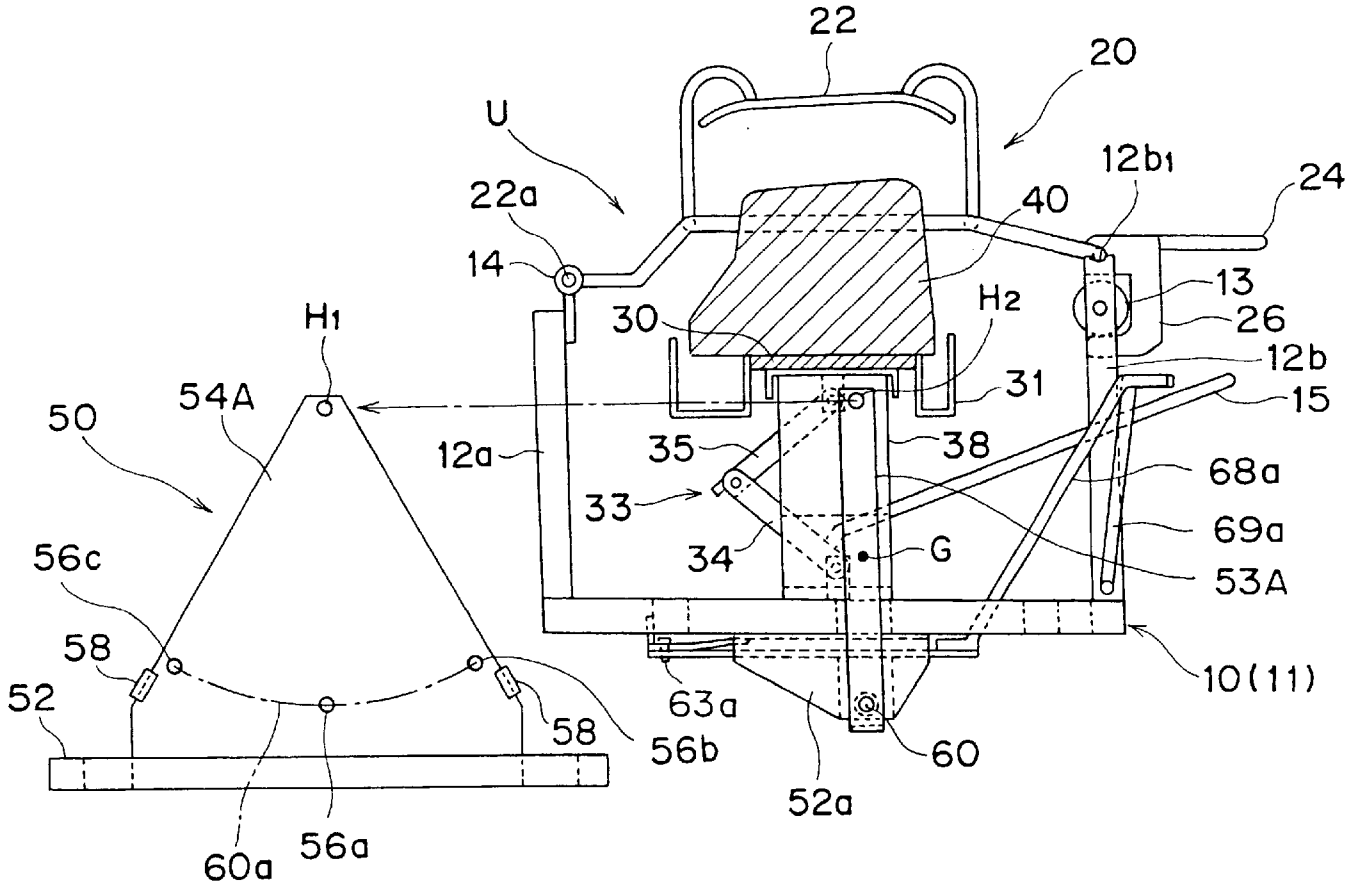
FIG. 4 is a side view of the same apparatus with the paint mask main body separated from the fixed base.
Figure 5A:
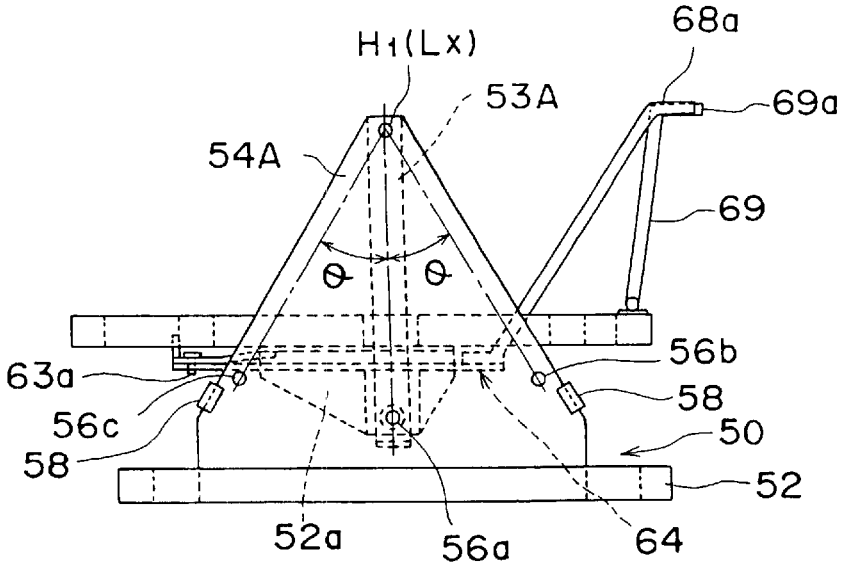
FIG. 5A is a side view showing the position fixing mechanism in the same apparatus.
Figure 5B:
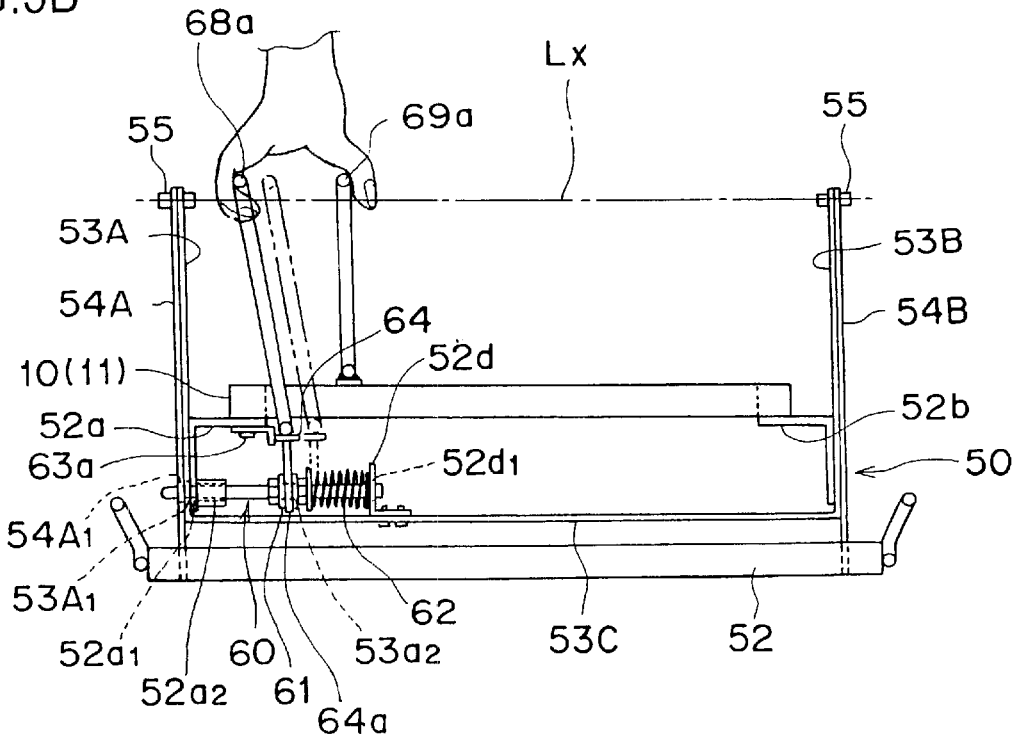
FIG. 5B is a front view of the same position fixing mechanism.
Figure 6A:
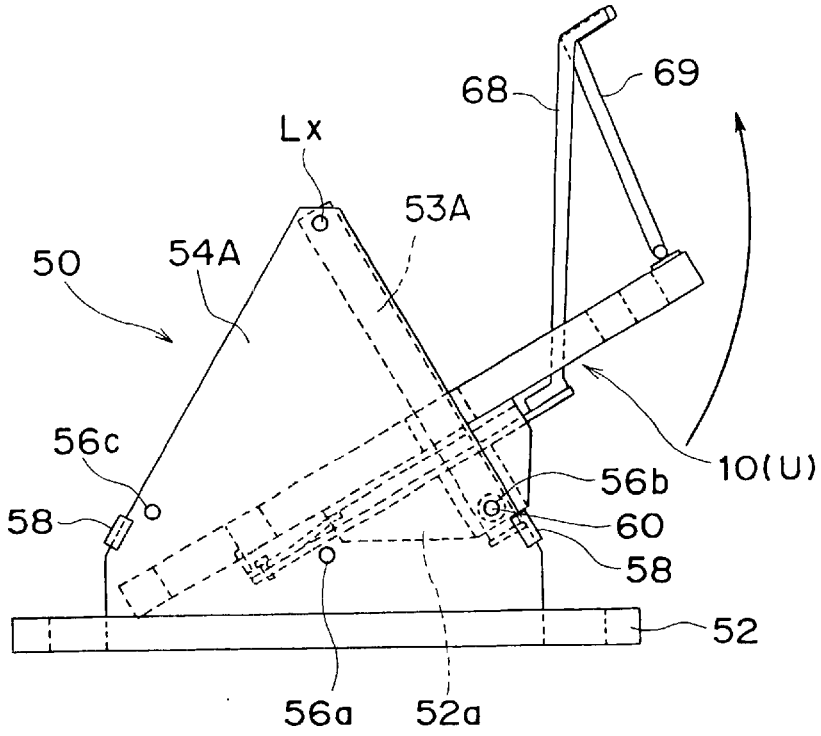
FIG. 6A is a side view of the same apparatus with the back (front) end side of the paint mask apparatus main body tilted up (down) illustrating the tilt range of the paint mask apparatus main body.
Figure 6B:
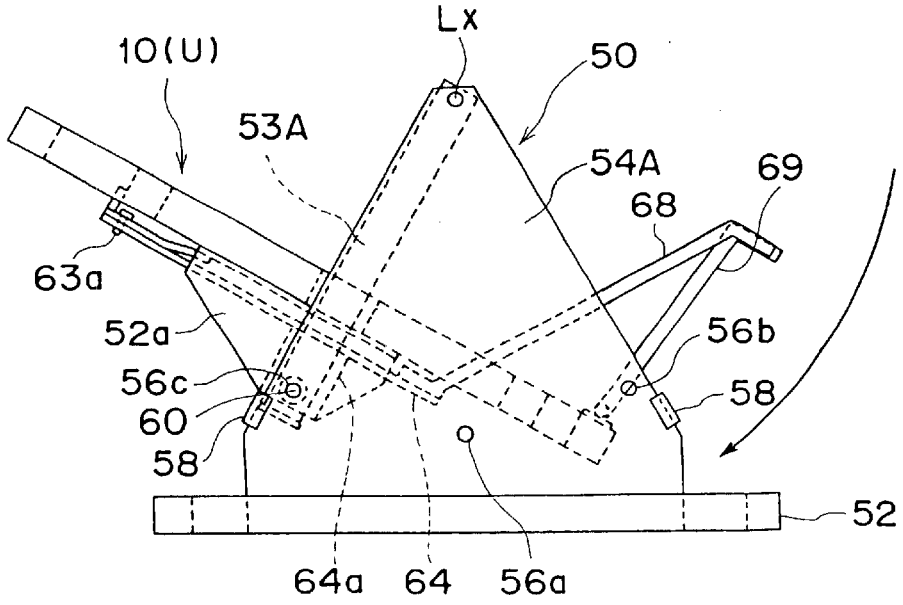
FIG. 6B is a side view of the same apparatus with the front (back) of the paint mask apparatus main body tilted up (down)

A U-shaped frame 53 is formed such that the open side thereof is facing up, with substantially the center portion is of the frame body 11 of the moveable base 10, which forms the apparatus main body U, supported in the front/rear direction (the left/right direction in FIG. 1) via angle members 52*a*, 52*b*, as shown in FIG. 5B. A pair of left and right band-shaped vertical plates 53A, 53B positioned opposing the vertical walls 54A, 54B on the fixed base 50 side are provided on the apparatus main body U side. A bolt hole $H_2$ (see FIG. 4) corresponding to the bolt hole $H_1$ in the vertical walls 54A, 54B is formed at the upper end portions of the vertical plates 53A, 53B, and a bolt B forming the support 55 is inserted through the bolt holes $H_1$, $H_2$.

A side plate 53C extending to the left and right of the U-shaped frame 53 extends below the left and right angle members 52*a*, 52*b*. The stopper pin 60, which is slidable to the left and right, is provided between the bracket 52*d* and the angle member 52*a* attached to the side plate 53C, inserted through a hole 54$A_1$ in the vertical wall 54A, a hole 53$A_1$ in the vertical plate 53A, a hole 52$a_1$ in the angle member 52*a*, and a hole 52$d_1$ in the bracket 52*d*.

A collar 52$a_2$ which functions as a slide guide for the stopper pin 60 is securely fixed to the angle member 52*a* such that when a lever 68, to be described in more detail later, is operated so as to reverse the stopper pin 60 (move it to the right in FIG. 5B), there is no danger of the stopper pin 60 falling out of the holes 54$A_1$ (53$A_1$, 52$a_1$) because the tip of the pin is inside the collar 52$a_2$.

A flange 61 is integrated with the stopper pin 60, and a compressed coil spring 62 is disposed between the flange 61 and the bracket 52*d*. The tip portion of the stopper pin 60 is spring-loaded in the direction in which it projects from the hole 53$A_1$ in the vertical plate 53 (the direction in which it projects to the vertical wall 54A side). Accordingly, when the apparatus main body U (the moveable base 10) is tilted such that the stopper pin 60 is in a position aligned with the pin engaging hole 56, the stopper pin 60 engages the pin engaging hole 56 by the spring force of the compressed spring 62 so as prevent it from slipping out therefrom. As a result, the moveable base 10 (the paint mask apparatus main body U) is maintained fixed relative to the fixed base 50.

A vertical bracket 64*a* integrated with a horizontal swing lever 64, which is, swingable horizontally around a vertical pin fulcrum 63, is fit loosely on the pin 60. Further, a release lever 68 extending at an upward angle is integrated with the horizontal swing lever 64.

A handle 68*a* of this release lever 68 is provided so as to be in close proximity to a fixed lever 69 attached upright to the moveable base 10 (the frame body 11). As shown in FIG. 5B, when the handles 68*a*, 69*a* of both levers 68, 69 are grabbed with the left hand and the release lever 68 is moved to the fixed lever 69 side (see the broken line in FIG. 5B), the horizontal swing lever 64 (the release lever 68) swings around the vertical pin fulcrum 63 such that the vertical bracket 64*a* moves in the direction to compress the spring 62, whereupon the stopper pin 60 is pushed inside the vertical plate 53A (the angle member 52*a*) against the spring force of the spring 62 (the stopper pin 60 moves to the right in FIG. 5B). This disengages the stopper pin 60 from the engaging hole 56 in the vertical wall 54A so that the paint mask apparatus main body U is no longer fixed with respect to the fixed base 50.

Figure 3:
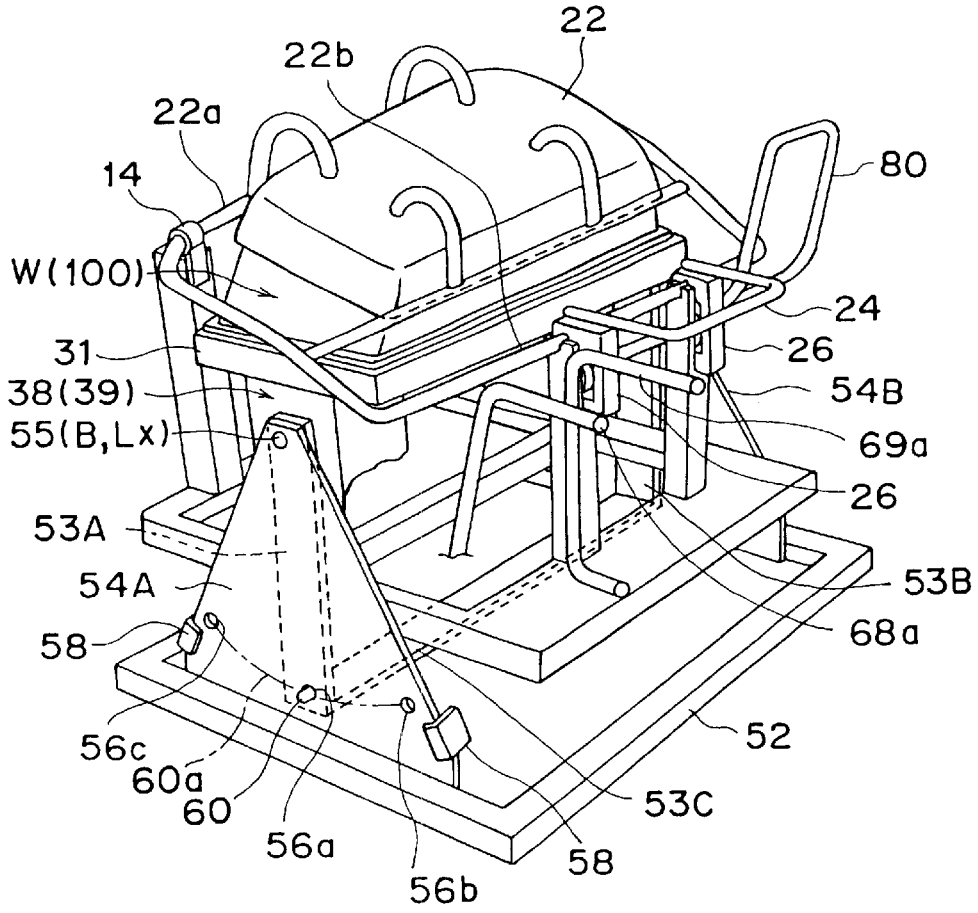
FIG. 3 is a perspective view of the same apparatus omitting the link mechanism and the link mechanism operating lever.

Reference numeral 80 in FIG. 3 denotes a handle attached to the moveable base 10. The apparatus main body U can be swung (tilted) around the horizontal axis Lx by grabbing this handle 80 with the right hand and pushing or pulling the apparatus main body U. When the apparatus main body U has begun to swing and the release lever 68 is released, the stopper pin 60 will be moved in the direction in which it projects to the vertical wall 54A side by the force of the spring, the tip of the pin will abut against the vertical wall 54A, projecting no further, and the pin will slide against the vertical wall 54A according to the tilt of the apparatus main body U.

When the stopper pin 60 comes to a position in which it is aligned with the pin engaging hole 56, it automatically engages with the pin engaging hole 56 by the force of the spring such that the paint mask apparatus main body U is maintained fixed in a predetermined position around the horizontal axis Lx. At this time, the work W is tilted such that the area to be painted is open in the direction from which paint is to be sprayed by a spray gun 70. In this state, the area to be painted is then painted using the spray gun 70.

Reference letter G shown in FIGS. 1 and 4 indicates the center of gravity of the paint mask apparatus main body U, which acts as a pendulum. The paint mask apparatus main body U has good stability because the center of gravity G is lower than the center of the pendulum (the horizontal axis Lx).

Next, the painting process of two areas $A_1$, $A_2$ to be painted of a lens 100, that is, the work W, using the painting apparatus described above will be described with reference to FIG. 7.

First, with the mask supporting frame 20 in the open state, the area above the receiving jig 40 is open and work W is set onto the receiving jig 40 from above, as shown in FIG. 2. Next, the mask supporting frame 20 is swung down and the hook 26 is secured to the latch 13, thereby securing the mask supporting frame 20 to the moveable base 10.

The operating lever 15 is then pushed down so that the jig base 30 rises via the link mechanism 28 and the mask main is body 22 covers all but the areas to be painted $A_1$, $A_2$ of the work W, as shown in FIG. 7. At this time, the stopper pin 60 is engaged with the pin engaging hole 56*a*. The stopper pin 60 can be disengaged from the pin engaging hole 56*a* by grabbing the handles 68*a*, 69*a* of the release lever 68 and the fixed lever 69 with the left hand. The apparatus main body U is then tilted counterclockwise by grabbing the handle 80 with the right hand and pulling forward.

After the apparatus main body U has begun to be swung, the release lever 68 is released by the left hand such that the stopper pin 60 slides along the vertical wall 54A.

Figure 7B:
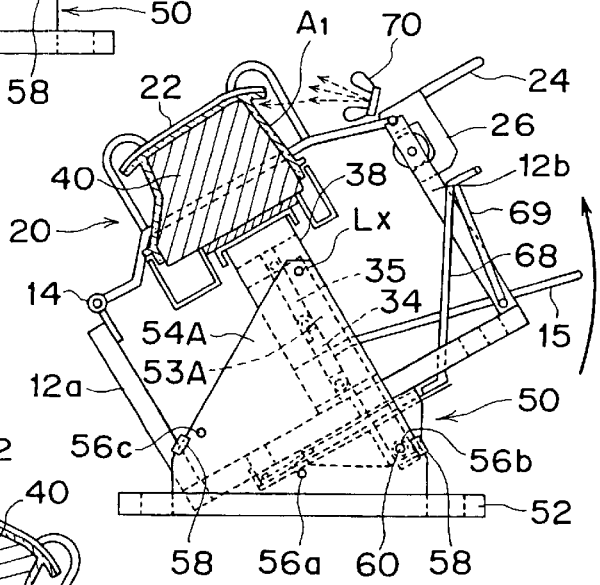
FIG. 7B is a side view of the same apparatus showing the paint mask apparatus main body in a tilted state.

When the stopper pin 60 arrives at a position in which it is aligned with the pin engaging hole 56*b*, the stopper pin 60 automatically engages the pin engaging hole 56*b* such that the apparatus main body U is maintained fixed in a tilted state, as shown in FIG. 7B. Then the work W (the lens 100) supported on the receiving jig 40 points so that the first area to be painted $A_1$ is open in the direction from which paint is to be sprayed by a spray gun 70. In this state, the pray gun 70 points toward the work W and proceeds to a predetermined position. The spray gun 70 then runs in the left/right direction (the direction perpendicular to the paper in FIG. 7B) while spraying paint, thereby painting the area to be painted $A_1$.

When the painting of the first area $A_1$ is complete, the spray gun 70 backs up to a predetermined position where it will not be in the way for the tilting operation of the apparatus main body U. Then, the handle is grabbed again with the right hand and the handles 68*a*, 69*a* of the release lever 68 and the fixed lever 69 are grabbed with the left hand so as to disengage the stopper pin 60 from the pin engaging hole 56*b*, and with both hands these members are pushed so as to tilt the apparatus main body U clockwise.

Figure 7C:
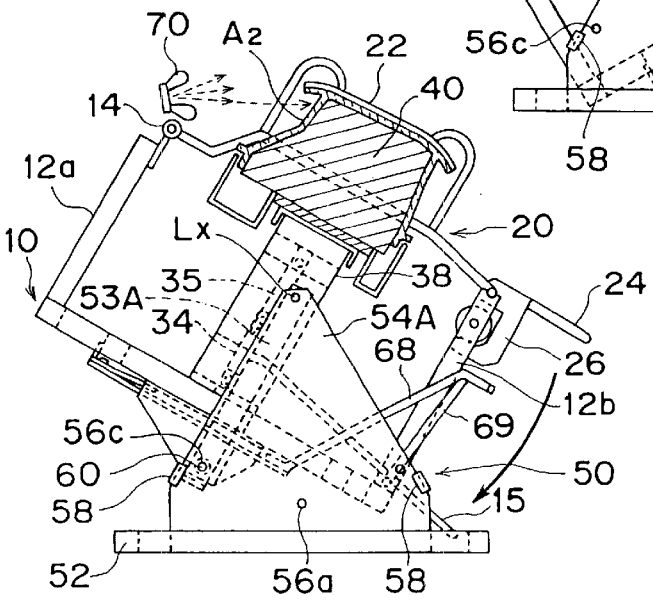
FIG. 7C is a side view of the same apparatus showing the paint mask apparatus main body in a tilted state.
Figure 8:
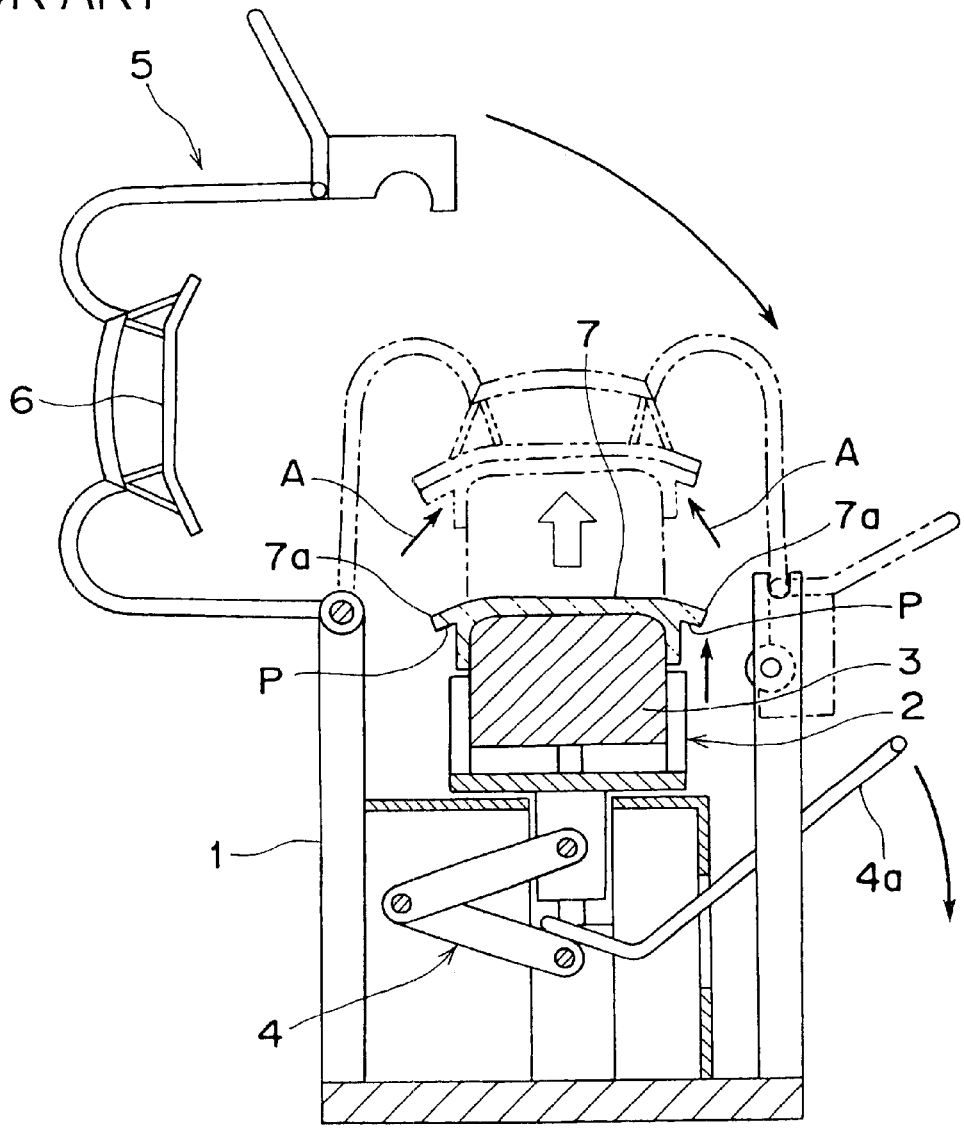
FIG. 8 PRIOR ART
FIG. 8 is a longitudinal sectional view of a conventional paint mask apparatus.

When the release lever 68 grabbed with the left hand is released when the stopper pin 60 passes the pin engaging hole 56*a* and arrives at a position in which it is aligned with the pin engaging hole 56*c*, the stopper pin 60 engages the pin engaging hole 56*c* such that the apparatus main body U is maintained fixed in a tilted state, as shown in FIG. 7C. Then, the work W (the lens 100) supported on the receiving jig 40 points so that the second area to be painted $A_2$ is open in the direction from which paint is to be sprayed by a spray gun 70. In this state, the spray gun 70 points toward the work W and proceeds to a predetermined position. The spray gun 70 then runs in the left/right direction (the direction perpendicular to the paper in FIG. 7C) while spraying paint, thereby painting the area to be painted $A_2$.

When the painting of the second area $A_2$ to be painted is complete, the spray gun 70 backs up to a predetermined position where it will not be in the way for the tilting operation of the apparatus main body U. Then, the handles 68*a*, 69*a* of the release lever 68 and the fixed lever 69 are grabbed so as to disengage the stopper pin 60 from the pin engaging hole 56*b*, and the apparatus main body U is tilted back to its original position. The stopper pin 60 engages the pin engaging hole 56*a*, thereby securing the apparatus main body U with respect to the fixed base 50.

The apparatus main body U in a tilted state naturally tilts so that the center of gravity G falls directly below the horizontal axis Lx where the fulcrum lies, with the moment of the inertial force from the deadweight. Therefore, the apparatus main body U can be easily tilted from the state shown in FIG. 7B to the state shown in FIG. 7C, or from the state shown in FIG. 7C to the state shown in FIG. 7A without the operator having to actively push or pull the apparatus main body U.

Then, the operating lever 15 is operated such that the link mechanism 28 folds and the jig base 30 is lowered so that the receiving jig 40 upon which the work W is mounted separates from the mask main body 22. Finally, with the mask supporting frame 20 in the open state, the area above the receiving jig 40 is opened and the work W (the lens 100) which has finished being painted is removed from the receiving jig 40, as shown in FIG. 1.

In the foregoing embodiment, the receiving jig 40 is constructed so that it can be raised or lowered by a link mechanism 33, but the receiving jig 40 can also be fixed with the respect to the base 10.

As was made clear by the description above, with the paint mask apparatus according to the present invention, paint can be applied not only to portions that were difficult to paint conventionally, but can also easily be applied to a plurality of different places in a single painting process merely by tilting the paint mask apparatus main body so that the work can be set in a predetermined position that facilitates the painting process.

The work can be maintained in a position so that it points in a predetermined direction that facilitates the painting process, thereby enabling the painting operation to be carried out smoothly.

Both the paint mask apparatus main body and the work can be easily tilt-adjusted to a predetermined tilted position, thereby enabling the painting operation to be carried out much more smoothly.

Also, the paint mask apparatus can be moved by changing the position of the fixed base, thereby improving the degree of freedom of the layout of the production line in which the apparatus is employed.

Moreover, the paint mask apparatus main body is extremely stable, thereby facilitating the tilting operation. In addition, the means by which the apparatus main body is maintained fixed is very simple in structure, thereby simplifying the construction of the entire apparatus.

Maintaining the paint mask apparatus main body fixed in a predetermined position around the horizontal axis and releasing it therefrom by operating a release lever can be accomplished easily, thereby enabling accurate painting of a plurality of areas on a work to be carried out smoothly.

With the invention, a lens for a vehicular lamp can be set in a predetermined position that facilitates the painting process by tilting the paint mask apparatus main body. This makes it possible to easily apply paint to the area extending from the rear side of the overhanging portion to the outside of the leg portion formed on the side edge of a surface design area, which was difficult to paint conventionally.

What is claimed is:

1. A paint mask apparatus, comprising: a paint mask apparatus main body comprising a receiving jig for receiving a work to be painted; a movable base on which said paint mask apparatus main body is mounted; a mask main body for covering predetermined portions of said work, said mask main body being pivotally mounted on said movable base; and a fixed base, said movable base being tiltably mounted on said fixed base about a horizontal axis of said fixed base.

2. The paint mask apparatus according to claim 1, further comprising a stopper mechanism for fixing and maintaining said paint mask apparatus main body in a predetermined tilt position relative to said fixed base.

3. The paint mask apparatus according to claim 1, wherein said fixed base comprises a pair of supports on left and right sides of said paint mask apparatus main body for tiltably mounting said paint mask apparatus main body to said fixed base.

4. The paint mask apparatus according to claim 3, wherein said horizontal axis is above the center of gravity of said paint mask apparatus main body.

5. The paint mask apparatus according to claim 1, wherein said fixed base comprises a pair of opposing vertical walls and a pair of opposing supports, one support on each of said vertical walls, for tiltably mounting said paint mask apparatus main body to said fixed base, and further comprising a stopper pin provided on said moveable base spring-loaded in a direction in which a tip portion of said stopper pin projects toward an adjacent one of said vertical walls, a plurality of pin engaging holes being provided in said adjacent one of said vertical walls at positions along a path of travel of said stopper pin along said vertical wall, said stopper pin being engageable with said pin engaging holes to fix a tilt position of said paint mask apparatus main body relative to said fixed base, and a release lever for moving said stopper pin in a direction so as to disengage said stopper pin from a pin engaging hole in which said stopper pin is engaged.

6. The paint mask apparatus according to claim 5, wherein said horizontal axis is above the center of gravity of said paint mask apparatus main body.

7. The paint mask apparatus according to claim 5, further comprising at least one stopper provided on at least one of said vertical walls for limiting a tilt angle of said paint mask apparatus main body relative to said fixed base.

8. The paint mask apparatus according to claim 1, wherein said work comprises a lens for a vehicular lamp comprising a surface design portion and a leg portion, an overhanging portion protruding to the outside beyond said leg portion being formed on a side edge of said surface design portion, an area from a rear side of said overhanging portion to an area outside said leg portion constituting an area to be painted.

9. The paint mask apparatus according to claim 1, further comprising a link mechanism for raising and lowering said paint mask apparatus main body relative to said fixed base.

10. The paint mask apparatus according to claim 1, further comprising a latch mechanism for selectively fixing said mask main body to said movable base, and a lever for manually operating said latch mechanism.

11. The paint mask apparatus according to claim 1, wherein said fixed base comprises a generally rectangularly shaped frame body and four braces standing upright at the four corners of front and rear ends of the frame body.

* * * * *